US006844685B2

(12) United States Patent
Lee

(10) Patent No.: US 6,844,685 B2
(45) Date of Patent: Jan. 18, 2005

(54) APPARATUS AND METHOD FOR DRIVING PLASMA DISPLAY PANEL

(75) Inventor: Joo-Yul Lee, Ahsan (KR)

(73) Assignee: Samsung SDI Co., Ltd., Suwon (KR)

( * ) Notice: Subject to any disclaimer, the term of this patent is extended or adjusted under 35 U.S.C. 154(b) by 0 days.

(21) Appl. No.: 10/627,580

(22) Filed: Jul. 24, 2003

(65) Prior Publication Data

US 2004/0085262 A1 May 6, 2004

(30) Foreign Application Priority Data

Jul. 26, 2002 (KR) ..... 10-2002-0044245

(51) Int. Cl.[7] ..... G09G 3/10

(52) U.S. Cl. ..... 315/169.3; 315/169.1; 345/60; 345/204

(58) Field of Search ..... 315/169.1, 169.3, 315/169.4; 345/55, 60, 68, 76, 211–213, 204

(56) References Cited

U.S. PATENT DOCUMENTS 5,745,086 A 4/1998 Weber ..... 315/169.4
6,476,561 B2 * 11/2002 Okada ..... 315/169.1
6,633,285 B1 * 10/2003 Kigo et al. ..... 345/204
2002/0186184 A1 * 12/2002 Lim ..... 345/60

FOREIGN PATENT DOCUMENTS

JP 2001-242824 9/2001
JP 2002-72957 3/2002

* cited by examiner

*Primary Examiner*—Don Wong
*Assistant Examiner*—Jimmy Vu
(74) *Attorney, Agent, or Firm*—Christie, Parker and Hale, LLP

(57) ABSTRACT

A method for driving a plasma display panel that has a plurality of scan electrodes and sustain electrodes arranged in pairs, and a plurality of address electrodes intersecting the scan electrodes and the sustain electrodes and being electrically isolated from the scan electrodes and the sustain electrodes. The method includes applying a voltage of a rising ramp waveform having at least two slopes and a voltage of a falling ramp waveform having at least two slopes to the scan electrodes during a reset period. Thus, the method applies the reset waveform having at least two slopes in the reset step so as to reduce the reset period and allow a stable reset operation.

21 Claims, 18 Drawing Sheets

FIG.10A(2)
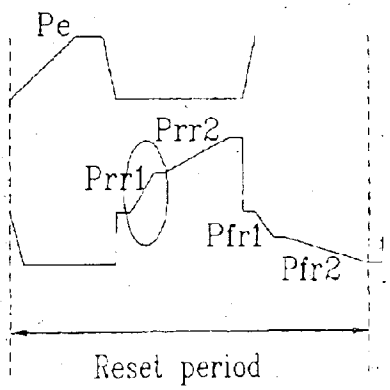
FIG.10A(1)
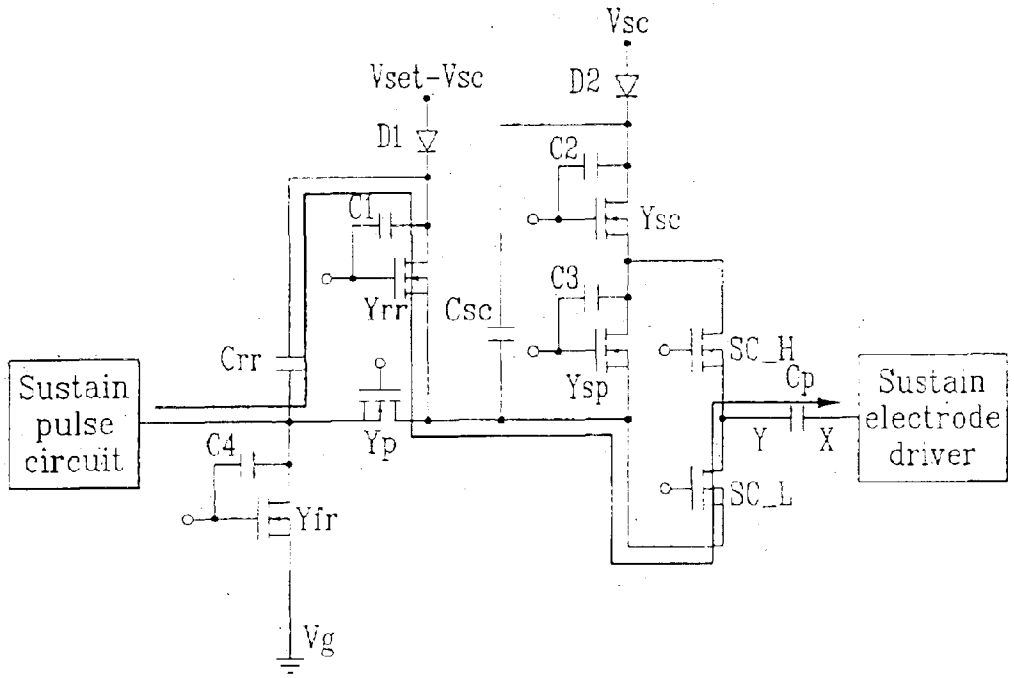

FIG.10B(2)
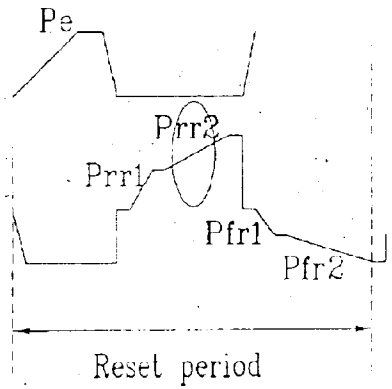
FIG.10B(1)
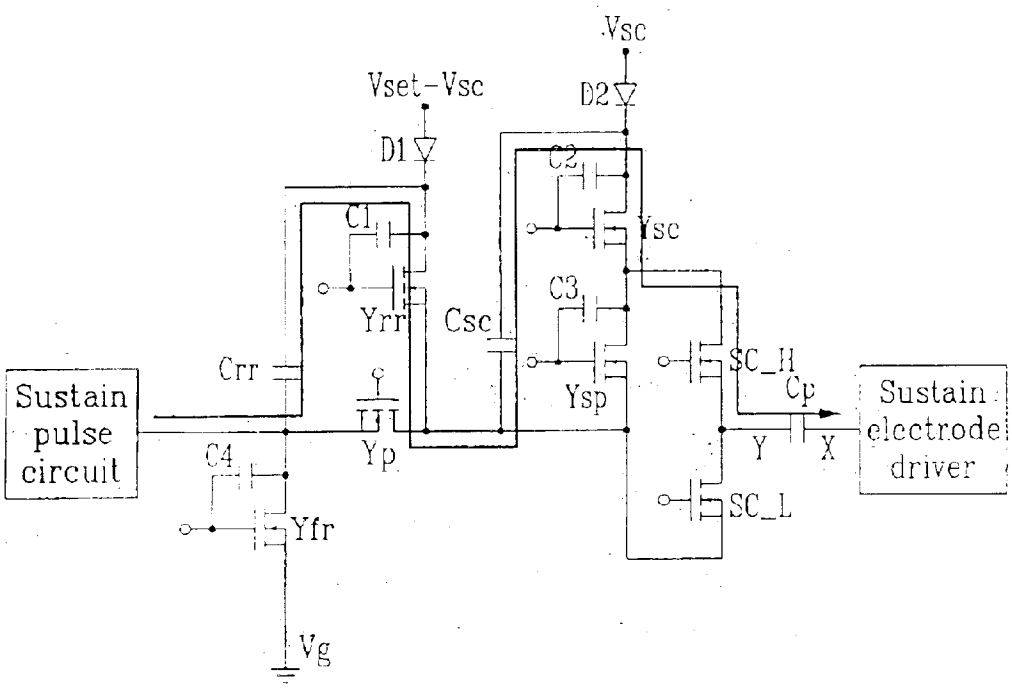

FIG.10C(2)
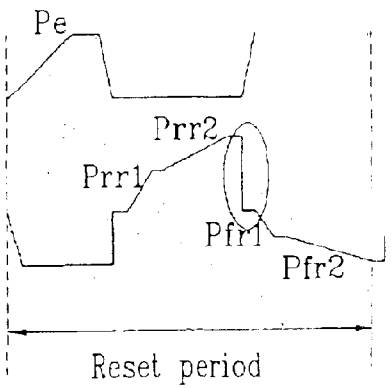
FIG.10C(1)
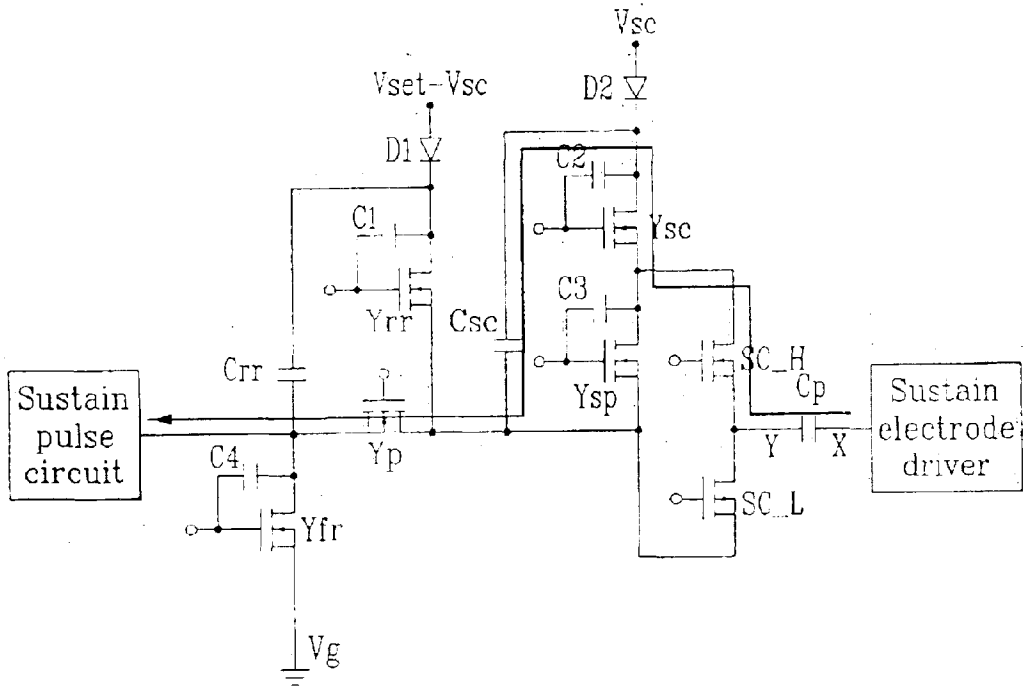

FIG.10D(2)
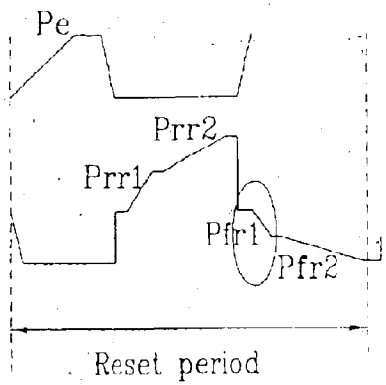
FIG.10D(1)
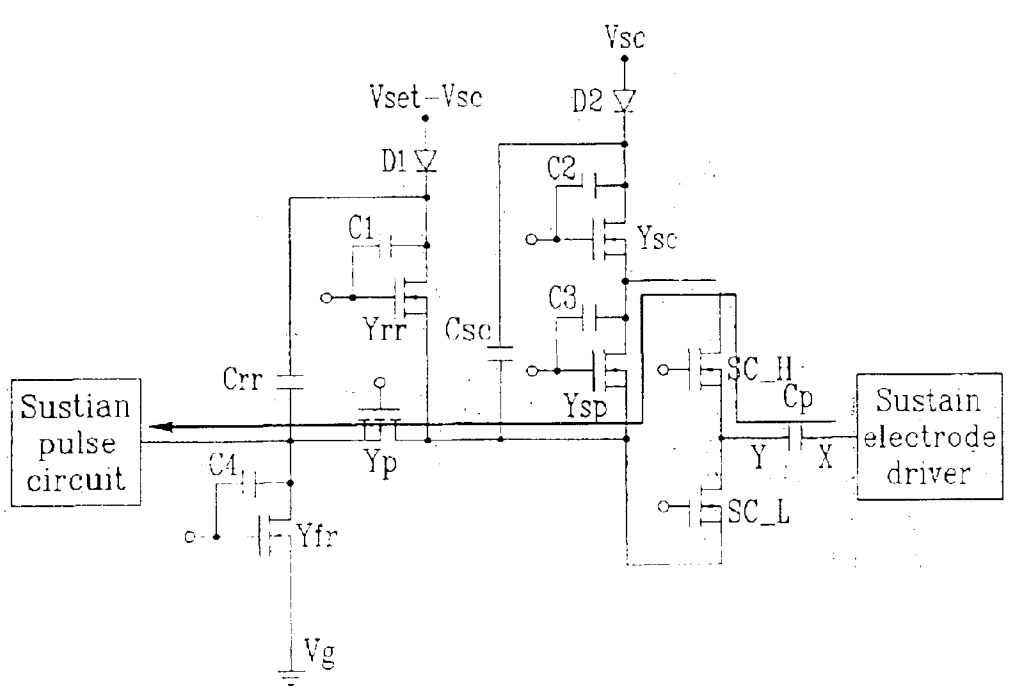

FIG.10E(2)
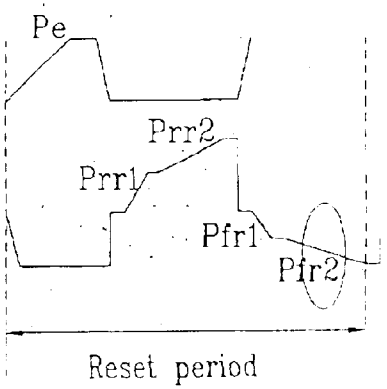
FIG.10E(1)
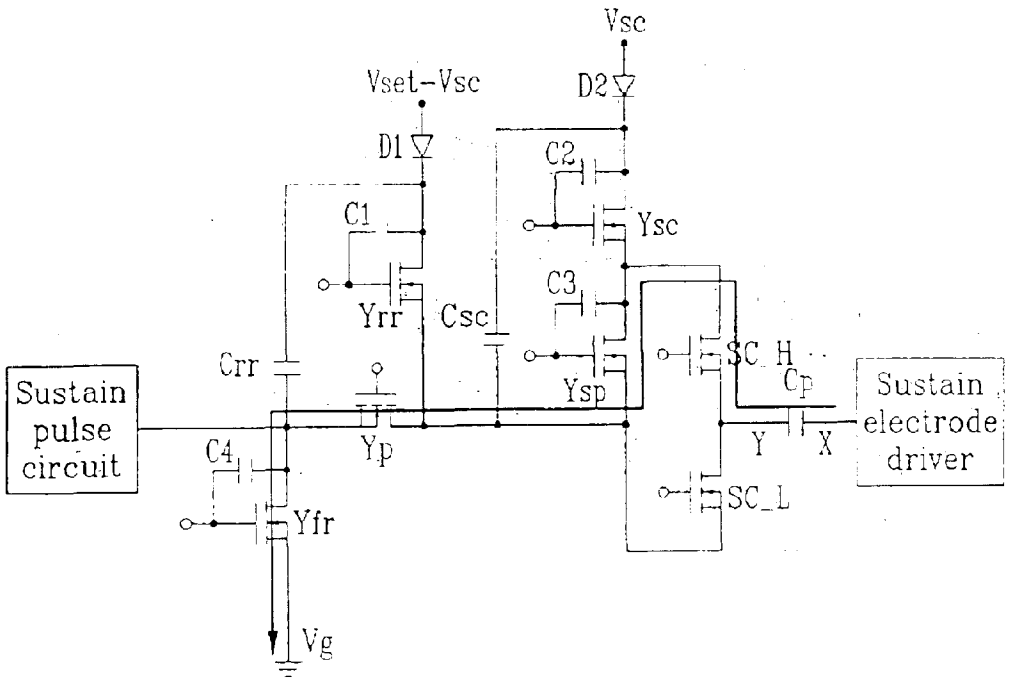

FIG.13A(2)
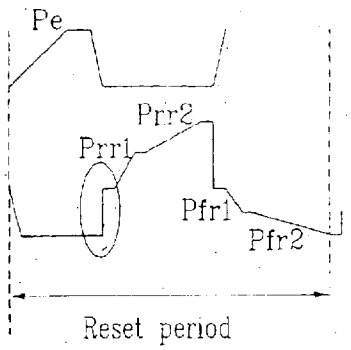
FIG.13A(1)
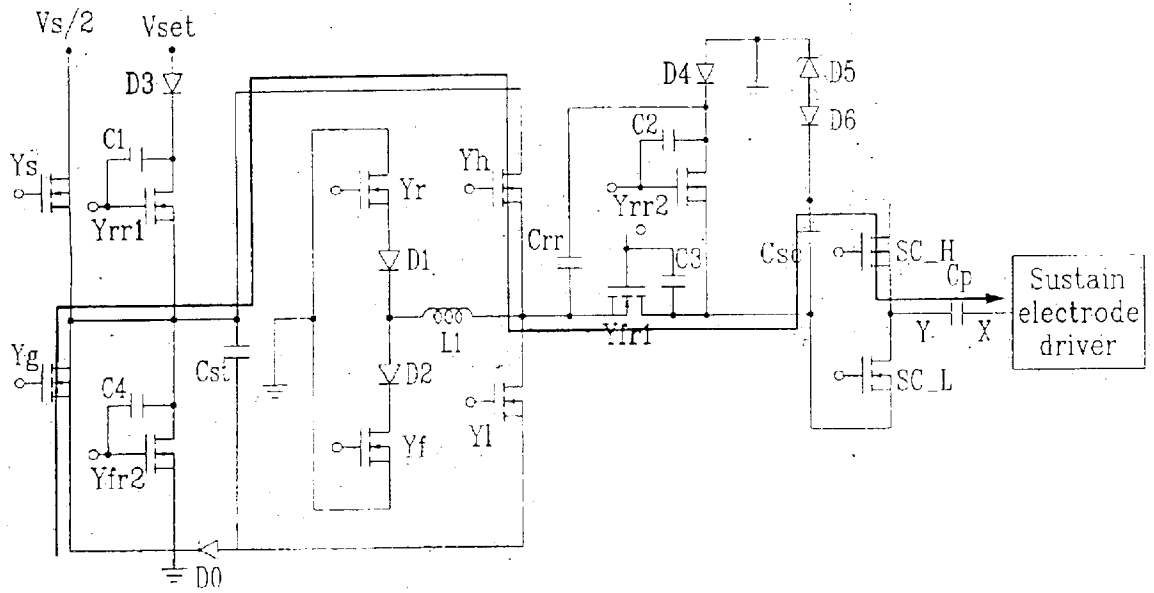

FIG.13B(2)
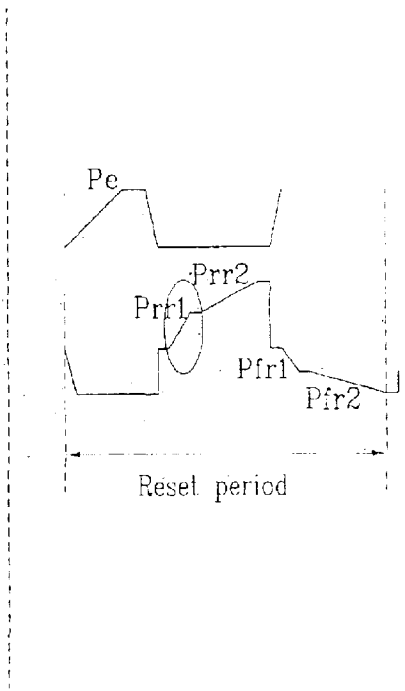
FIG.13B(1)
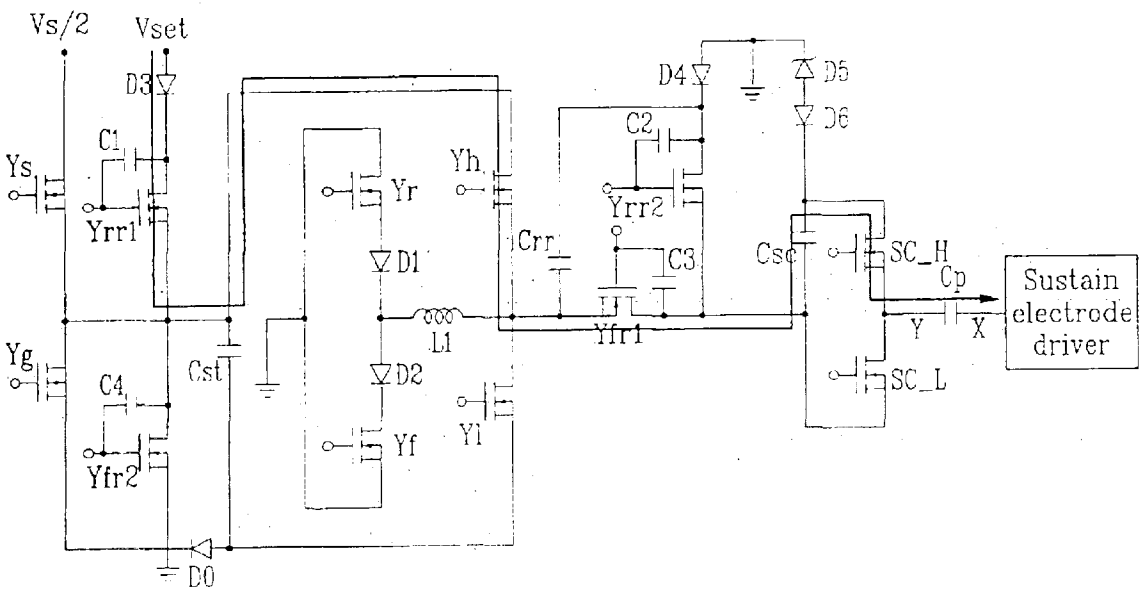

FIG.13C(2)
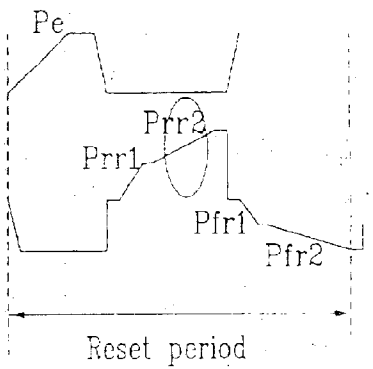
FIG.13C(1)
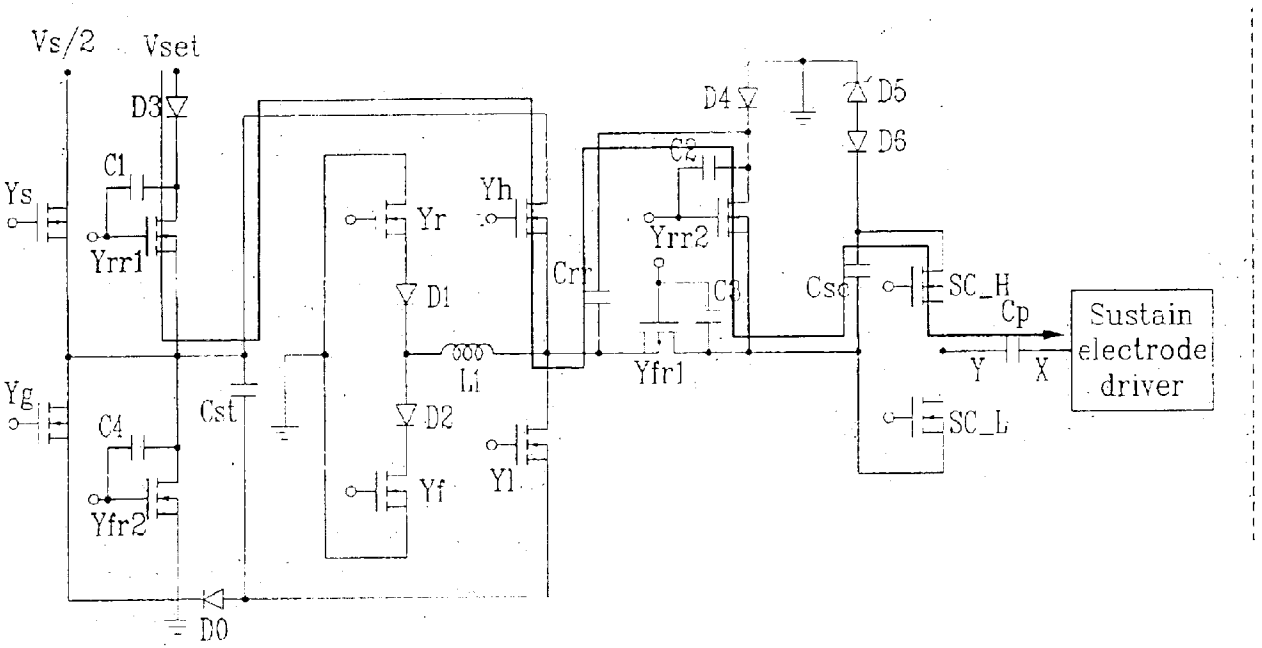

FIG.13D(2)
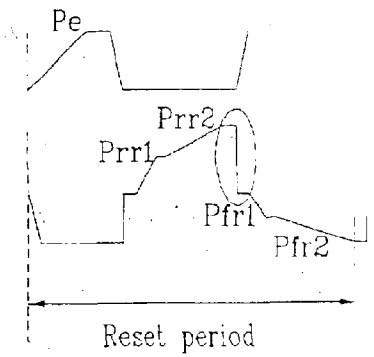
FIG.13D(1)
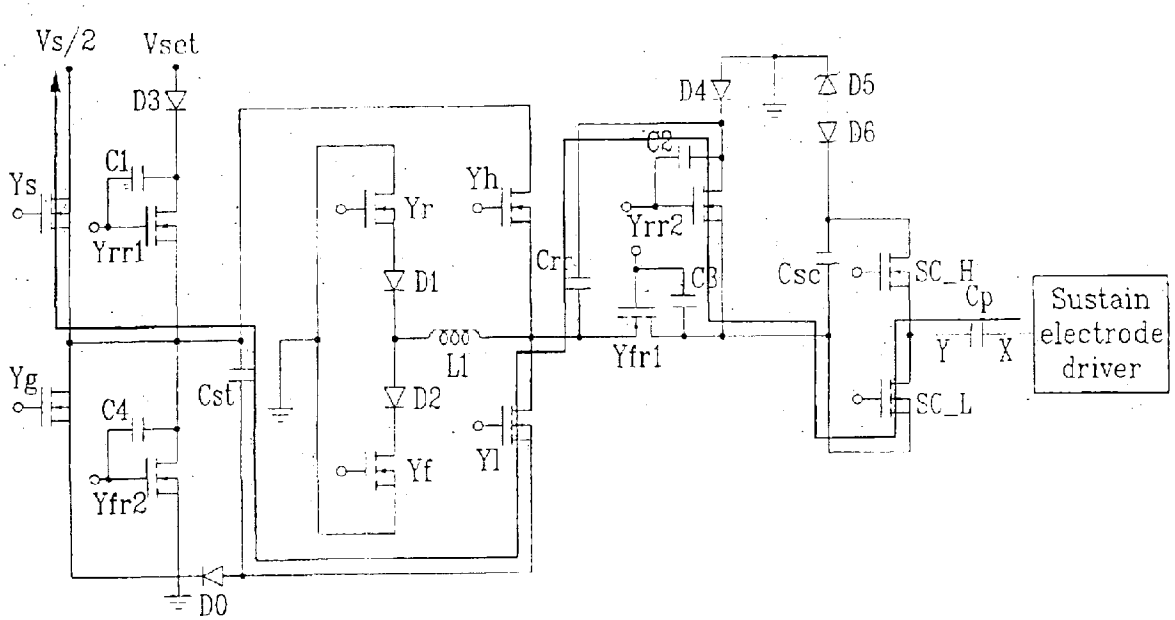

FIG.13E(1)
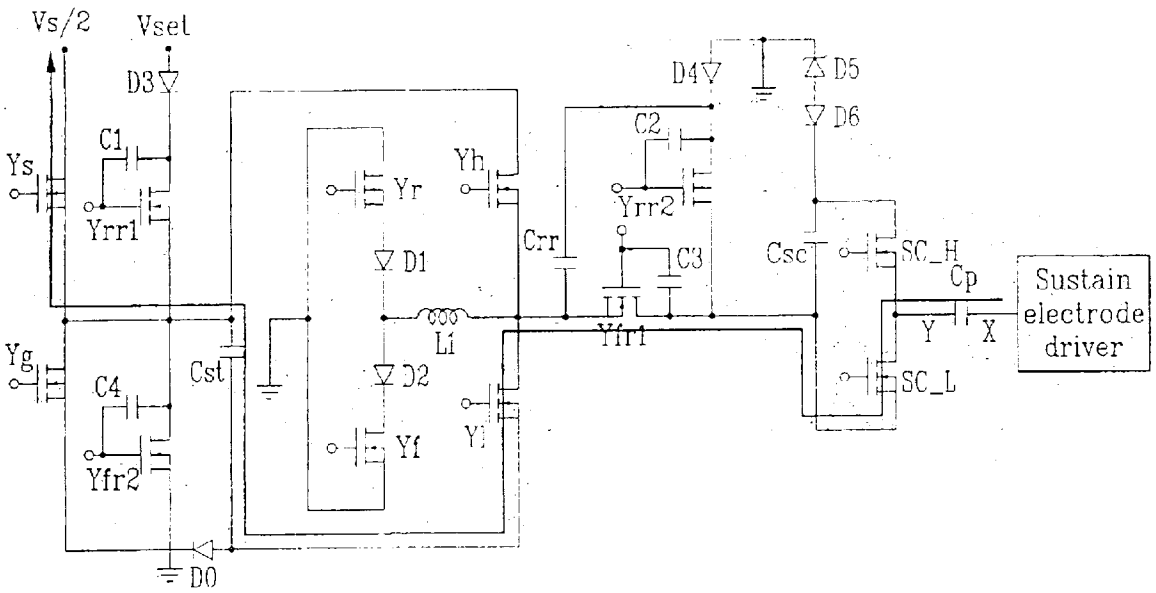
FIG.13F(2)
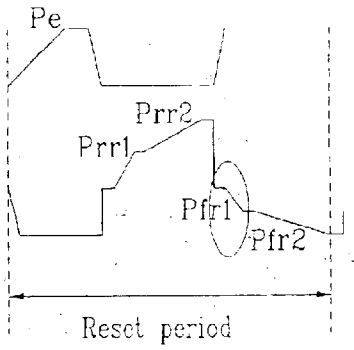

FIG.13F(2)
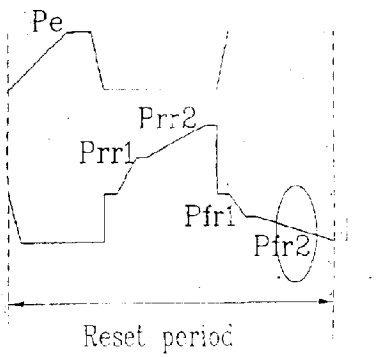
FIG.13F(1)
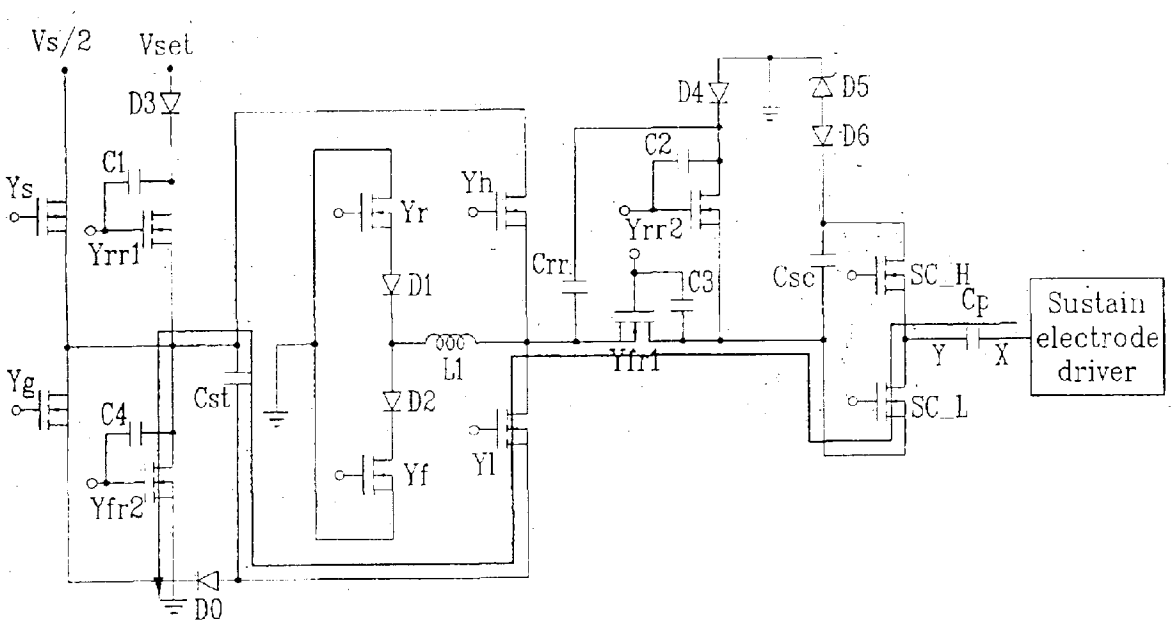

APPARATUS AND METHOD FOR DRIVING PLASMA DISPLAY PANEL

CROSS REFERENCE TO RELATED APPLICATION

This application claims priority to and the benefit of Korea Patent Application No. 2002-0044245 filed on Jul. 26, 2002 in the Korean Intellectual Property Office, the content of which is incorporated herein by reference.

BACKGROUND OF THE INVENTION (a) Field of the Invention

The present invention relates to an apparatus and method for driving a plasma display panel (PDP).

(b) Description of the Related Art

In recent years, flat panel displays such as liquid crystal displays (LCD), field emission displays (FED), PDPs, and the like have been actively developed. The PDP is advantageous over the other flat panel displays in regard to its high luminance, high luminous efficiency, and wide view angle, and accordingly it is favorable for making large-scale screens of more than 40 inches as a substitute for the conventional cathode ray tube (CRT).

The PDP is a flat panel display that uses plasma generated by gas discharge to display characters or images, and it includes, according to its size, more than several scores to millions of pixels arranged in a matrix pattern. Such a PDP is classified into a direct current (DC) type and an alternating current (AC) type according to its discharge cell structure and the waveform of the driving voltage applied thereto.

The DC PDP has electrodes exposed to a discharge space to allow DC flowing through the discharge space while the voltage is applied, and thus requires a resistance for limiting the current. On the other hand, the AC PDP has electrodes covered with a dielectric layer that forms a capacitance component to limit the current and protects the electrodes from the impact of ions during a discharge, and is thus superior to the DC PDP in regard to a long lifetime.

FIG. 1 is a partial perspective view of an AC PDP. Referring to FIG. 1, pairs of scan electrode 4 and sustain electrode 5 covered with dielectric layer 2 and protective layer 3 are arranged in parallel on first glass substrate 1. A plurality of address electrodes 8 covered with insulating layer 7 are arranged on second glass substrate 6. Partition walls 9 are formed in parallel with address electrodes 8 on insulating layer 7 and are interposed between address electrodes 8. Fluorescent material 10 is formed on the surface of insulating layer 7 and on both sides of partition walls 9. First glass substrate 1 and second glass substrate 6 are arranged in a face-to-face relationship with discharge space 11 formed therebetween, so that scan electrode 4 and sustain electrode 5 lie in a direction perpendicular to address electrodes 8. Discharge spaces at intersections between address electrodes 8 and the pairs of scan electrode 4 and sustain electrode 5 form discharge cells 12.

FIG. 2 shows an arrangement of the electrodes in the PDP. The PDP has a pixel matrix consisting of m×n discharge cells. More specifically, address electrodes $A_1$ to $A_m$ are arranged in m columns, and scan electrodes $Y_1$ to $Y_n$ and sustain electrodes $X_1$ to $X_n$ are alternately arranged in n rows. Discharge cells 12 shown in FIG. 2 correspond to discharge cells 12 of FIG. 1.

Typically, the driving method of the AC type PDP includes a reset period, an address period, and a sustain period. In the reset period, the state of each cell is initialized so as to facilitate an addressing operation on the cell. In the address period, wall charges are accumulated in a selected cell (i.e., addressing cell) that is turned on in the panel. In the sustain period, a discharge occurs to actually display an image on the addressing cells.

In the design of the PDP driving waveform, the reset waveform is very significant. A description will now be given as to the reset waveform of the conventional AC type PDP and the driving method of the same.

Basically, the reset operation involves erasing wall charges resulting from the previous discharge and setting them up to facilitate the next addressing discharge operation. The PDP has several millions of cells, each of which has a slightly different discharge voltage. But there is the difficulty of controlling the discharge of all the cells with one defined driving voltage. It is therefore very important to overcome the difference in discharge voltage among the cells while erasing wall charges and resetting them in the reset period. The reset waveform is divided into a part involving erasing wall charges caused by the previous discharge, and a part involving solving the problem with regard to the dispersion of the discharge voltage among cells and redistributing the wall charges for facilitating the addressing.

Namely, the reset period is an interval for applying a voltage of a specific form for the purpose of facilitating the operation of the subsequent address period. A stable display operation of a plasma display panel inferior in inter-cell uniformity can be achieved according to the operational characteristics of this period.

The waveform mainly used in the reset period to stably operate display devices having poor inter-cell uniformity is the ramp waveform of FIG. 3, which is disclosed in U.S. Pat. No. 5,745,086. In the waveform of FIG. 3, a display device having poor inter-cell uniformity performs a more stable display operation when the ramp waveform has a gentler slope, of less than 15 V/$\mu$s. If the slope is set at about 2 V/$\mu$s for stable operation, then an excessive time of as long as double the time of 200 $\mu$s, i.e., 400 $\mu$s is required for a voltage of 400 V. An improvement of this waveform is illustrated in FIG. 4.

In the waveform of FIG. 4, instead of continuously changing the voltage to a required voltage level with a ramp waveform, a voltage that is high enough to not cause a discharge in the discharge cells of the PDP is changed instantaneously, and a ramp waveform is then applied. However, this method causes an intense discharge when the instantaneously varying voltage is extremely high, allowing no stable reset operation. Accordingly, too much time is required for the reset period in this case.

The conventional PDP driving apparatus is comprised of a sustain pulse circuit and a ramp waveform forming circuit. The voltage in the reset period must be high enough to guarantee stable operation of the driving apparatus, and it is much higher than the voltage in the sustain period. Accordingly, a main path switch is necessary for interrupting the ramp waveform forming circuit driven with a high voltage and the sustain circuit driven with a low voltage. The main path switch must have a high withstand voltage.

According to the conventional PDP driving circuit and method, when the reset waveform has a steep slope or when the instantaneously varying voltage is high, a stable reset operation is not guaranteed. Otherwise, when the reset waveform has a gentle slope, the reset period is prolonged but the sustain period is difficult to increase, thereby deteriorating the brightness.

Furthermore, the switches that serve to interrupt the ramp waveform forming circuit driven with a high voltage and the sustain pulse circuit driven with a low voltage must have a high withstand voltage. However, the higher withstand voltage leads to a higher price of the switches, causing a problem with regard to cost.

SUMMARY OF THE INVENTION

In accordance with the present invention a reset waveform is formed for reducing the reset period and allowing a stable reset operation in the PDP driving method. Further, the withstand voltage of switches serving to interrupt a reset circuit or a sustain circuit is reduced, thereby allowing the use of inexpensive switches to lower the cost of the PDP.

In one aspect of the present invention, there is provided a method for driving a plasma display panel that has a plurality of scan electrodes and sustain electrodes arranged in pairs, and a plurality of address electrodes intersecting the scan electrodes and the sustain electrodes and being electrically isolated from the scan electrodes and the sustain electrodes. The method includes: during a reset period, (a) applying to the scan electrodes a voltage of a ramp waveform rising from a first voltage to a second voltage with substantially a first slope; and (b) applying to the scan electrodes a voltage of a ramp waveform rising from the second voltage to a third voltage with substantially a second slope gentler than the first slope.

The method may further include: (c) applying to the scan electrodes a voltage of a ramp waveform rising from the third voltage to a fourth voltage with substantially a third slope gentler than the second slope.

The method may still further include: before the step (a), applying to the scan electrodes an erasing voltage of a ramp waveform erasing wall charges formed in a sustain period.

In another aspect of the present invention, there is provided a method for driving a plasma display panel that has a plurality of scan electrodes and sustain electrodes arranged in pairs, and a plurality of address electrodes intersecting the scan electrodes and the sustain electrodes and being electrically isolated from the scan electrodes and the sustain electrodes. The method includes: during a reset period, applying to the scan electrodes a voltage of a ramp waveform falling from a first voltage to a second voltage with substantially a first slope; and (b) applying to the scan electrodes a voltage of a ramp waveform falling from the second voltage to a third voltage with substantially a second slope gentler than the first slope.

The method may further include: (c) applying to the scan electrodes a, voltage of a ramp waveform falling from the third voltage to a fourth voltage with substantially a third slope gentler than the second slope.

In further another aspect of the present invention, there is provided an apparatus for driving a plasma display panel that has a plurality of scan electrodes and sustain electrodes arranged in pairs, and a plurality of address electrodes intersecting the scan electrodes and the sustain electrodes and being electrically isolated from the scan electrodes and the sustain electrodes. The apparatus includes a first capacitor and a second capacitor coupled to a first voltage and a second voltage, respectively, the first capacitor and the second capacitor charged to a third voltage and a fourth voltage, respectively. A first rising ramp switch is coupled to one terminal of the first capacitor for applying a voltage of a ramp waveform rising with substantially a first slope to the scan electrode. A second rising ramp switch is coupled to one terminal of the second capacitor for applying a voltage of a ramp waveform rising with substantially a second slope to the scan electrodes. A first falling ramp switch applies a voltage of a ramp waveform falling with substantially a third slope to the scan electrodes. A second falling ramp switch is coupled between the one terminal of the first falling ramp switch and a fifth voltage for applying a voltage of a ramp waveform falling with substantially a fourth slope to the scan electrodes.

In still another aspect of the present invention, there is provided a method for driving a plasma display panel that has a plurality of scan electrodes and sustain electrodes arranged in pairs, and a plurality of address electrodes intersecting the scan electrodes and the sustain electrodes and being electrically isolated from the scan electrodes and the sustain electrodes. The method includes charging a first capacitor with a first voltage and a second capacitor with a second voltage; supplying a substantially constant first current to the scan electrodes through the first capacitor, and increasing a voltage of the scan electrodes by the first voltage from a third voltage in a first slope; supplying a substantially constant second current to the scan electrodes through the first and second capacitors, and increasing the voltage of the scan electrodes by the fourth voltage in a second slope; decreasing the voltage of the scan electrodes to a fifth voltage through the second capacitor; recovering a substantially constant third current from the scan electrodes, and decreasing the voltage of the scan electrodes to a sixth voltage in a third slope; and recovering a substantially constant fourth current from the scan electrodes, and decreasing the voltage of the scan electrodes to a seventh voltage in a fourth slope.

In a still further aspect of the present invention, there is provided an apparatus for driving a plasma display panel that has a plurality of scan electrodes and sustain electrodes arranged in pairs, and a plurality of address electrodes intersecting the scan electrodes and the sustain electrodes and being electrically isolated from the scan electrodes and the sustain electrodes. The apparatus includes a first capacitor for charging a third voltage when one terminal thereof is coupled to a first voltage and the other terminal thereof is coupled to a second voltage. A second capacitor and a third capacitor respectively charge a fourth voltage and a fifth voltage. A first rising ramp switch is formed in a path between a sixth voltage and the third capacitor for increasing a voltage of the scan electrodes in a ramp waveform having substantially a first slope. A second rising ramp switch is formed in a path generated by the first rising ramp switch, the second capacitor, and the third capacitor for increasing the voltage of the scan electrodes in a ramp waveform having substantially a second slope. A first falling ramp switch is formed in a path between the scan electrodes and the other terminal of the first capacitor for decreasing the voltage of the scan electrodes in a ramp waveform having substantially a third slope. A second falling ramp switch is formed in a path between the second voltage and the one terminal of the first capacitor for decreasing the voltage of the scan electrodes in a ramp waveform having substantially a fourth slope.

In still further another aspect of the present invention, there is provided a method for driving a plasma display panel that has a plurality of scan electrodes and sustain electrodes arranged in pairs, and a plurality of address electrodes intersecting the scan electrodes and the sustain electrodes and being electrically isolated from the scan electrodes and the sustain electrodes The method includes: charging a first capacitor having one terminal thereof selectively coupled to a first voltage and a second voltage, a second capacitor, and a third capacitor with a third voltage, a fourth voltage, and a fifth voltage, respectively, and the third voltage corresponding to a difference between the first voltage and the second voltage; applying the second voltage to the scan electrodes through the third capacitor to change a voltage of the scan electrodes to a sixth voltage; supplying a substantially constant first current to the scan electrodes through a seventh voltage and the capacitor to increase the voltage of the scan electrodes to an eighth voltage in a ramp waveform having a first slope; supplying a substantially constant second current to the scan electrodes through the seventh voltage and the second and third capacitors to increase the voltage of the scan electrodes to a ninth voltage in a ramp waveform having a second slope; decreasing the voltage of the scan electrodes to the tenth voltage through the second and first capacitors while one terminal of the first capacitor is coupled to the first voltage; recovering a substantially constant third current to the first voltage from the scan electrodes through the first capacitor while one terminal of the first capacitor is coupled to the first voltage, to decrease the voltage of the scan electrodes to an eleventh voltage in a ramp waveform having a third slope; and recovering a substantially constant fourth current to the second voltage from the scan electrodes while one terminal of the first capacitor is coupled to the second voltage, to decrease the voltage of the scan electrodes to a twelfth voltage in a ramp waveform having a fourth slope.

BRIEF DESCRIPTION OF THE DRAWINGS

FIGS. 10A(1) to 10E(1) illustrate the current path and FIGS. 10A(2) to 10E(2) illustrate the corresponding reset waveform, in each mode according to the first embodiment of the present invention.

FIGS. 13A(1) to 13F(1) illustrate the current path and FIGS. 13A(2) to 13F(2) illustrate the corresponding reset waveform, in each mode according to the third embodiment of the present invention.

DETAILED DESCRIPTION

Figure 1:
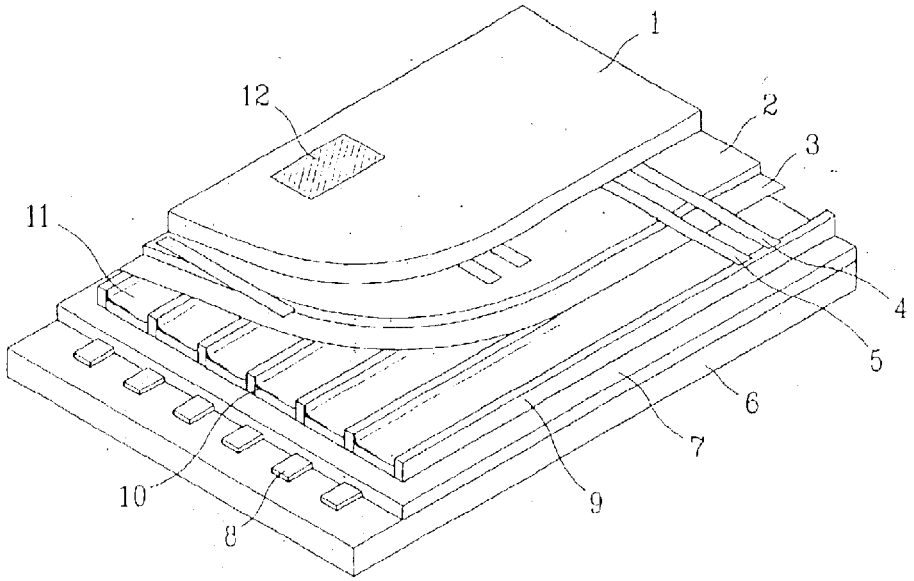
FIG. 1 is a partial perspective of an AC type PDP.
Figure 2:
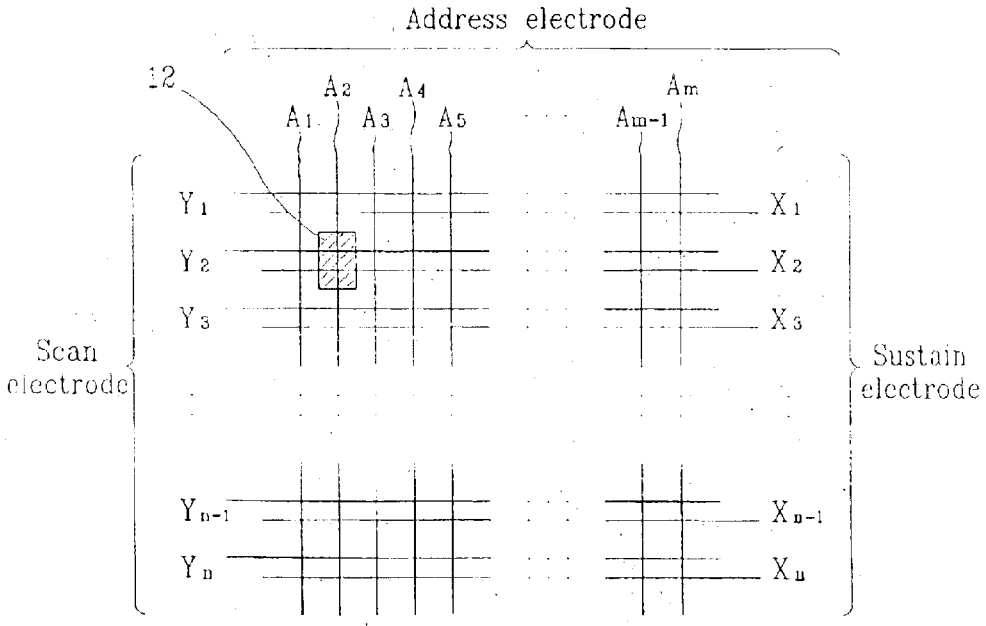
FIG. 2 illustrates an arrangement of electrodes in a PDP.
Figure 3:
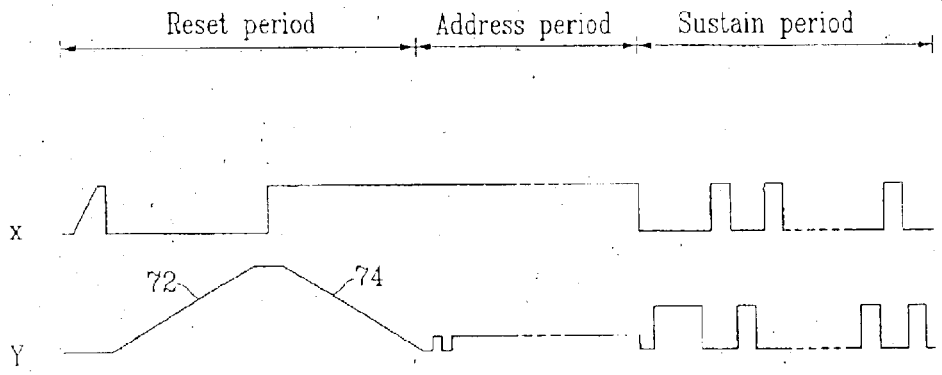
FIG.3(Prior Art)
FIGS. 3 and 4 illustrate a driving waveform of a conventional PDP.
Figure 4:
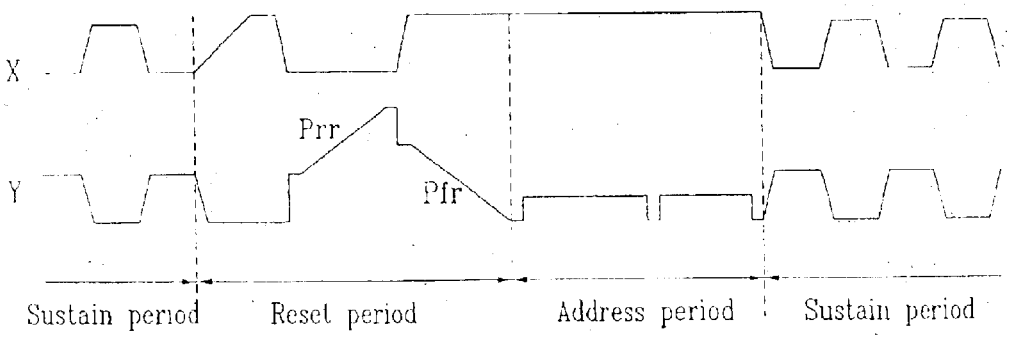
FIG.4(Prior Art)
Figure 5:
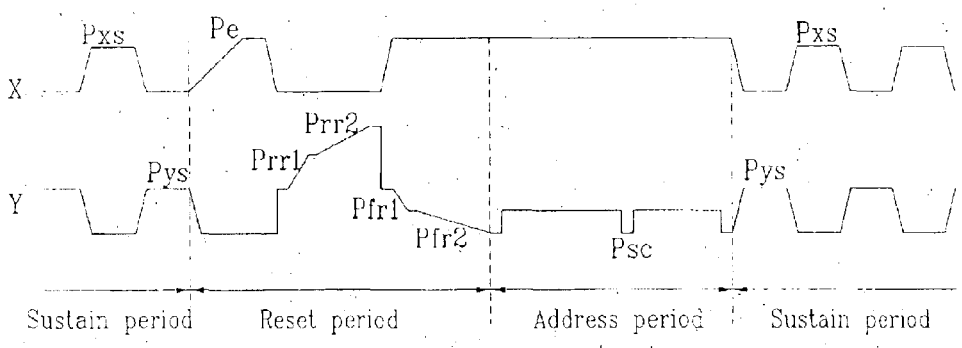
FIGS. 5, 6, and 7 illustrate driving waveforms of PDPs according to first, second, and third embodiments of the present invention, respectively.

A PDP driving method according to an embodiment of the present invention will now be described in detail with reference to the accompanying drawings. FIG. 5 illustrates a driving waveform of a PDP according to a first embodiment of the present invention. Referring to FIG. 2 and FIG. 5, ramp waveform Pe applied to sustain electrodes X at the beginning of the reset period is a waveform for erasing wall charges formed in the sustain period. Slowly rising ramp waveform Pe causes a weak discharge to erase the wall charges. After erasing the wall charges with ramp waveform Pe, ramp waveforms Prr1, Prr2, Pfr1, and Pfr2 are sequentially applied to scan electrodes Y.

Slowly rising ramp waveforms Prr1 and Prr2 cause a weak discharge, uniformly accumulating negative (−) wall charges on scan electrodes Y and positive (+) wall charges on the address electrodes and sustain electrodes X.

The discharge in the intervals of ramp waveforms Prr1 and Prr2 must occur stably so as to form uniform wall charges on the electrodes of each cell when applying ramp waveform Prr2. For this purpose, the slopes of the ramp waveforms must be gentle. Particularly, pulse Prr2 determining the final state must have a) gentle slope. Ramp waveform Prr1 may have a steeper slope than ramp waveform Prr2 because wall charges have only to be formed uniformly in the interval of ramp waveform Prr2 even though they are not uniformly formed in the interval of ramp waveform Prr1.

After ramp waveform Prr2, slowly falling ramp waveforms Pfr1 and Pfr2 are applied to scan electrodes Y so as to make no difference in the wall charges between scan electrodes Y and sustain electrodes X while sustaining positive (+) charges on the address electrodes.

An addressing must occur stably during the address period subsequent to ramp waveform Pfr2 so as to operate the PDP stably. For a stable addressing, wall charges must be uniformly accumulated at the end of the reset period. Namely, the wall charges must be uniformly accumulated after ramp waveform Pfr2. For this purpose, the slope of ramp waveform Pfr2 must be gentle. Accordingly, the wall charges have only to be accumulated in the interval of ramp waveform Pfr2 even though they may not be uniformly distributed in the interval of ramp waveform Pfr1, as a result of which the whole operation can be stably performed even with a steep slope of ramp waveform Pfr1.

According to the PDP driving waveform in the first embodiment of the present invention, ramp waveform Prr shown in FIG. 5 includes two ramp waveforms Prr1 and Prr2, and ramp waveform Pfr includes two ramp waveforms Pfr1 and Pfr2. It is assured that the slope is steep for ramp waveforms Prr1 and Pfr1 but gentle for ramp waveforms Prr2 and Pfr2, thereby guaranteeing a stable discharge operation as in the conventional reset waveform and reducing the reset time to enhance the overall brightness.

However, in the driving waveform according to the first embodiment of the present invention as shown in FIG. 5, the voltage of scan electrodes Y is changed from the sustain voltage to the ground voltage after the last sustain, possibly causing a discharge between the address electrodes and scan electrodes Y and hence an unstable discharge.

The problem with the discharge between the address electrodes and the scan electrodes may be solved by using an erase waveform of sustain electrodes X for fine erasing. However, the waveform of FIG. 6 can also be used to solve the problem.

Figure 6:
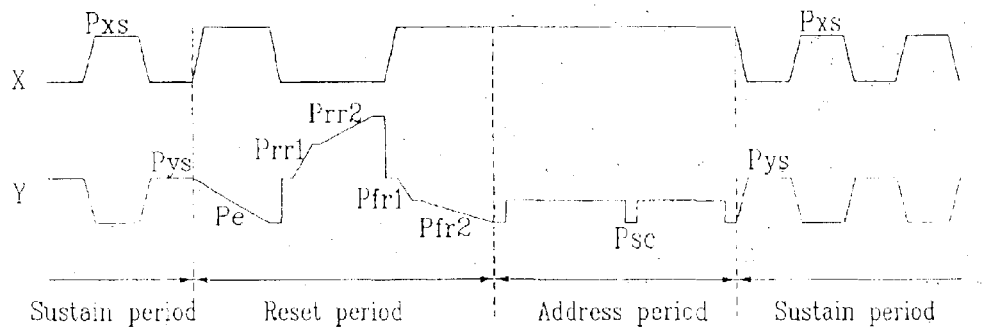

A description will now be given as to the PDP driving method according to a second embodiment of the present invention with reference to FIG. 6 which illustrates the driving waveform of the plasma display panel according to the second embodiment of the present invention. As illustrated in FIG. 6, the driving waveform according to the second embodiment of the present invention is the same as that according to the first embodiment, with the exception that voltage-falling ramp waveform Pe is applied to the scan electrodes at the beginning of the reset period, with a positive (+) voltage being applied to sustain electrodes X. In this manner, the second embodiment of the present invention applies ramp waveform Pe to scan electrodes Y rather than sustain electrodes X so, as to prevent a discharge between the address electrodes and scan electrodes Y, thereby guaranteeing a stable discharge relative to the first embodiment of the present invention.

Figure 7:
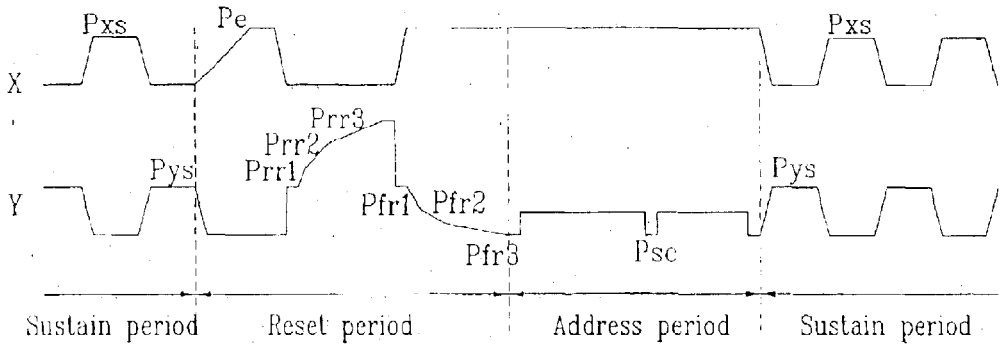

A description will now be given as to the PDP driving method according to a third embodiment of the present invention with reference to FIG. 7. Which illustrates the driving waveform of the plasma display panel according to the third embodiment of the present invention. As illustrated in FIG. 7, the driving waveform according to the third embodiment of the present invention is the same as that according to the first embodiment, with the exception that rising ramp waveforms Prr1, Prr2, and Prr3 or falling ramp waveforms Pfr1, Pfr2, and Pfr3 have three slopes in the reset period. The slopes of rising ramp pulses Prr1, Prr2, and Prr3, or the falling ramp pulses Pfr1, Pfr2, and Pfr3, are sequentially decreased. This is for accumulating wall charges uniformly in the last step to guarantee a stable reset operation.

The first, second, and third embodiments of the present invention have been described, but the PDP driving method of the present invention is not limited to the above-described first, second, and third embodiments. The PDP driving method according to the embodiments of the present invention may apply to the scan electrodes during the reset period, a rising ramp waveform voltage having one slope and a falling ramp waveform voltage having at least two slopes, or a rising ramp waveform voltage having at least two slopes and a falling ramp waveform voltage having one slope.

Figure 8:
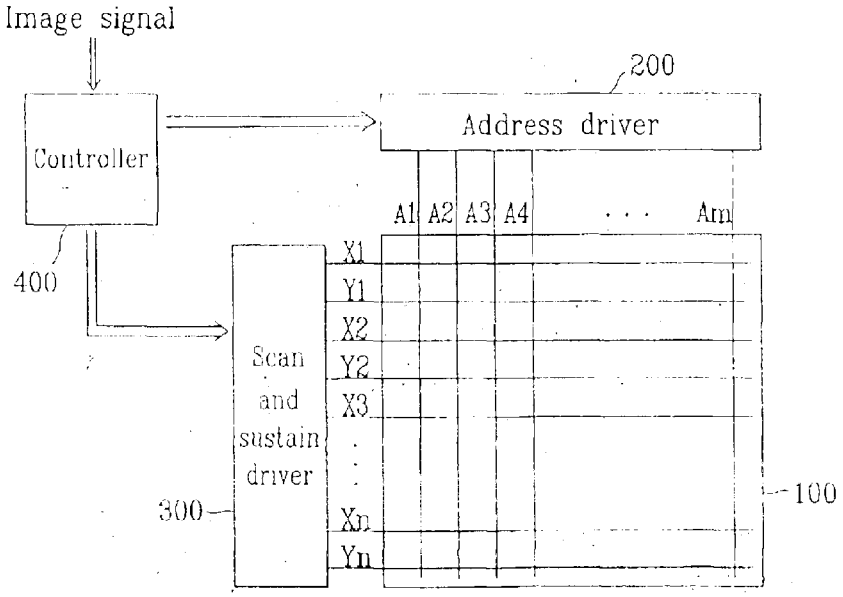
FIG. 8 illustrates a PDP according to an embodiment of the present invention.

A PDP driving apparatus according to an embodiment of the present invention will now be described in detail with reference to the accompanying drawings. FIG. 8 illustrates a PDP in accordance with an embodiment of the present invention, which includes, as shown in FIG. 8, plasma panel 100, address driver 200, scan/sustain driver 300, and controller 400. Plasma panel 100 includes a plurality of address electrodes $A_1$ to $A_m$ arranged in columns, and a plurality of scan electrodes $Y_1$ to $Y_n$ and sustain electrodes $X_1$ to $X_n$ alternately arranged in rows. Address driver 200 receives an address drive control signal from controller 400, and applies an address voltage for selection of discharge cells to be displayed to each address electrode. Scan/sustain driver 300 receives a sustain signal from controller 400 and applies a sustain voltage alternately to the scan electrodes and the sustain electrodes to cause a sustain on the selected discharge cells. Controller 400 receives an external image signal, generates the address drive control signal and the sustain signal, and applies the generated signals to address driver 200 and scan/sustain driver 300, respectively.

Figure 9:
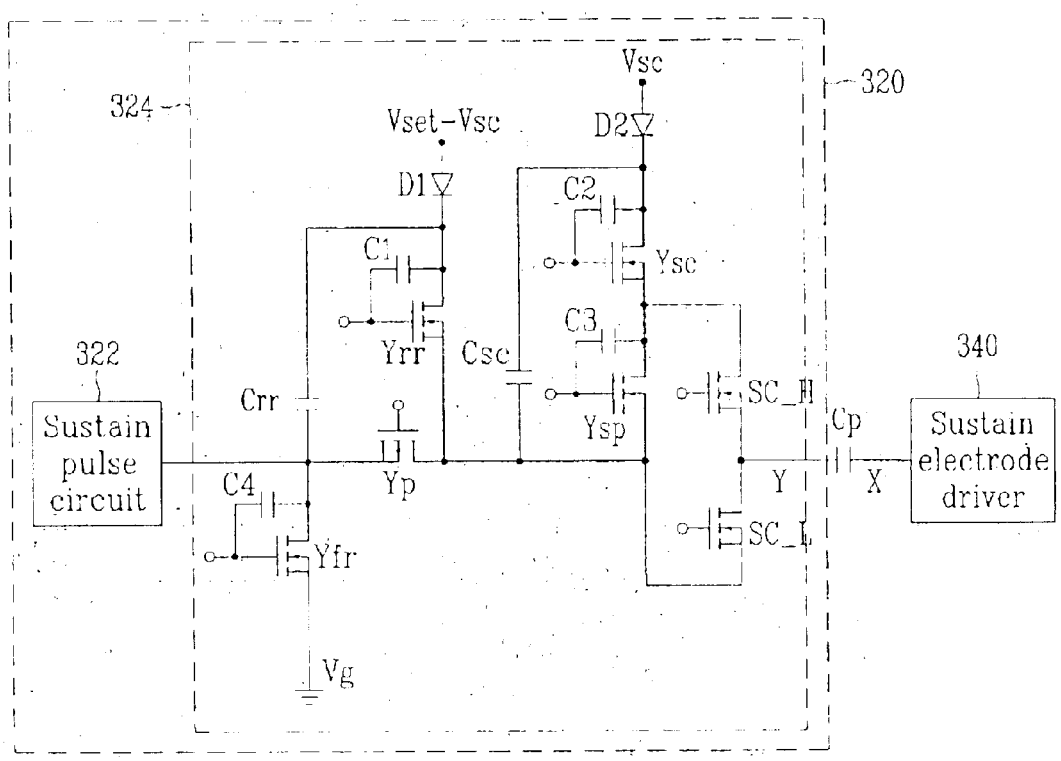
FIGS. 9, 11, and 12 are schematic circuit diagrams of PDP driving circuits according to the first, second, and third embodiments of the present invention, respectively.

FIG. 9 illustrates scan/sustain driver 300 according to the first embodiment of the present invention which includes scan electrode driver 320 and sustain electrode driver 340, which are the same in structure. In the following description, scan electrode driver 320 will be described alone.

Scan electrode driver 320 includes sustain pulse circuit 322 and ramp waveform forming circuit 324. Sustain pulse circuit 322 serves to sustain the voltage of the scan electrodes at sustain voltage Vs or ground voltage Vg. Ramp waveform forming circuit 324 includes first rising ramp switch Yrr and second rising ramp switch Ysc, first falling ramp switch Ysp and second falling ramp switch Yfr, main path switch Yp, capacitors Crr and Csc, switches SC_H and SC_L, and diodes D1 and D2.

First rising ramp switch Yrr has one terminal coupled to voltage Vset−Vsc through diode D1, and the other terminal coupled to scan electrodes Y of the PDP through switch SC_L.

Second rising ramp switch Ysc has one terminal coupled to scan electrodes Y through switch SC_H, and the other terminal coupled to voltage Vsc through diode D2.

First falling ramp switch Ysp has one terminal coupled to second rising ramp switch Ysc, and the other terminal coupled to scan electrodes Y through switch SC_L.

Second falling ramp switch Yfr has the one terminal coupled to scan electrodes Y through main path switch Yp and switch SC_L, and the other terminal coupled to ground voltage Vg.

Each switch shown in FIG. 9 includes a MOSFET and has a body diode (not shown), through which the switch forms a current path.

First rising ramp switch Yrr and second rising ramp switch Ysc and first falling ramp switch Ysp and second falling ramp switch Yfr have capacitors C1, C2, C3, and C4 coupled between their gates and drains, respectively, thereby maintaining constant gate-source voltage Vgs due to the Miller effect. Accordingly, K and Vt are constant in the following Equation 1 to cause a constant current.

[Equation 1]

$$i=K(Vgs-Vt)^2$$

With the constant current, a voltage of the ramp waveform having a slope of i/Cp is applied to both terminals of panel capacitor Cp due to the effect of panel capacitor Cp, as expressed by the following Equation 2.

$$V=\frac{1}{Cp}\int i dt \qquad \text{[Equation 2]}$$

Hence, the slope becomes gentler as the current i decreases. For the decrease in the current i, voltage Vgs must be low as expressed by Equation 1. The magnitude of voltage Vgs can be controlled by the capacitance values of gate-drain capacitors C1, C2, C3, and C4. For the reset waveform according to the embodiment of the present invention, the later ramp waveform must have the gentler slope, so the capacitance values of capacitors C1, C2, C3, and C4 are regulated to make the later ramp waveform have the gentler slope.

On the other hand, main path switch Yp has one terminal coupled to voltage Vset−Vsc through first rising ramp switch Yrr, and the other terminal coupled to sustain pulse circuit 322. So, main path switch Yp serves to interrupt the reset circuit driven with a high voltage and the sustain circuit driven with a low voltage. The withstand voltage of main path switch Yp is Vset−Vsc. Main path switch Yp also has a body diode.

Capacitor Crr is coupled between voltage Vset−Vsc and voltage Vg through second falling ramp switch Yfr, and capacitor Csc is coupled between voltage Vsc and voltage Vg through main path switch Yp and second falling ramp switch Yfr.

FIGS. 10A(1) to 10E(1) illustrate the current path and FIGS. 10A(2) to 10E(2) illustrate the corresponding reset waveform, in each mode according to the first embodiment of the present invention.

In the first embodiment of the present invention, it is assumed that before the start of Mode 1, voltage Vset−Vsc is charged on both terminals of capacitor Crr, and voltage Vsc is charged on both terminals of capacitor Cs. In the sustain pulse circuit, scan electrodes Y are coupled to the sustain voltage of Vs, and their voltage is increased instantaneously to Vs.

(1) Mode 1—See. FIG. 10A(1) and FIG. 10A(2).

In Mode 1, first rising ramp switch Yrr and switch SC_L are turned ON. Then, a, current path is formed that includes capacitor Crr, first rising ramp switch Yrr, and switch SC_L, in sequence. The contact voltage between capacitor Crr and first rising ramp switch Yrr rises to voltage Vs+Vset−Vsc, because capacitor Crr is charged with voltage Vset−Vsc, and the voltage at the other terminal of the capacitor is instantaneously increased to sustain voltage Vs.

First rising ramp switch Yrr has a capacitor coupled between its gate and drain, so that the voltage difference between the gate and the source of first rising ramp switch Yrr is constant, thereby forming a constant current. Hence, the voltage of scan electrodes Y rises in the ramp waveform due to the effect of panel capacitor Cp.

(2) Mode 2—See. FIG. 10B(1) and FIG. 10B(2).

In Mode 2, second rising ramp switch Ysc and switch SC_H are turned ON. Then, a current path is formed that includes capacitor Crr, first rising ramp switch Yrr, capacitor Csc, second rising ramp switch Ysc, and switch SC_H, in sequence.

Initially, capacitor Csc is charged with voltage Vsc. So, the voltage of the other terminal of capacitor Csc becomes voltage Vset−Vsc+Vs plus voltage Vsc, i.e., voltage Vset+Vs, as the contact voltage between capacitor Csc and first rising ramp switch Yrr rises to Vset−Vsc+Vs.

Second rising ramp switch Ysc has a capacitor coupled between its gate and drain, so that the voltage difference between the gate and the source of second rising ramp switch Ysc is constant, thereby forming a constant current. Then, the voltage of scan electrodes Y rises to voltage Vset+Vs in a ramp waveform due to the effect of panel capacitor Cp. According to the first embodiment of the present invention, the current between the drain and source of second rising ramp switch Ysc is assured to be lower than the current between the drain and source of first rising ramp switch Yrr, as a result of which the ramp waveform has a slope gentler than the slope in Mode 1.

(3) Mode 3—See. FIG. 10C(1) and FIG. 10C(2).

In Mode 3, main path switch Yp is turned ON, and the switch coupled to the sustain voltage in the sustain pulse circuit is turned ON. Then, a current path is formed that includes switch SC_H, the body diode of second rising ramp switch Ysc, capacitor Csc, and main path switch Yp, in sequence.

As the contact voltage between capacitor Csc and main path switch Yp instantaneously falls to the ground voltage, the voltage of the other terminal of capacitor Csc is instantaneously decreased to Vsc. Accordingly, with switch SC_H in the turned-on state, the voltage of scan electrodes Y also falls to Vsc instantaneously.

(4) Mode 4—See. FIG. 10D(1) and FIG. 10D(2).

In Mode 4, second rising ramp switch Ysc is turned OFF, and first falling ramp switch Ysp is turned ON. The switch coupled to the ground voltage in the sustain pulse circuit is also turned ON. Then, a current path is formed that includes switch SC_H, first falling ramp switch Ysp, and main path switch Yp, in sequence.

First falling ramp switch Ysp has a capacitor coupled between its gate and drain, so that the voltage difference between the gate and the source of first falling ramp switch Ysp is constant, thereby forming a constant current. Hence, the voltage of scan electrodes Y falls in a ramp waveform due to the effect of panel capacitor Cp.

(5) Mode 5—See. FIG. 10E(1) and FIG. 10E(2).

In Mode 5, second falling ramp switch Yfr is turned ON. Then, a current path is formed that includes switch SC_H, first falling ramp switch Ysp, main path switch Yp, and second falling ramp switch Yfr, in sequence.

Second falling ramp switch Yfr has a capacitor coupled between its gate and drain, so that the voltage difference between the gate and the source of second falling ramp switch Yfr is constant, thereby forming a constant current. Accordingly, the voltage of scan electrodes Y falls in a ramp waveform due to the effect of panel capacitor Cp.

Here, the ramp waveform has a slope that is assured to be gentler than the slope of the ramp waveform in Mode 4.

In the PDP driving method according to the first embodiment of the present invention, the voltage waveform applied to the scan electrodes in the reset period has at least two slopes so as to perform a reset operation of the same level for a time shorter than the time given to the conventional reset period, as a result of which more time is saved for the address period or the sustain period to increase the voltage operational range or the brightness.

The withstand voltage of the main path switch that serves to cut off the reset circuit driven with a high voltage from the sustain circuit driven with a low voltage has only to be greater than Vset−Vsc in the PDP driving apparatus of the present invention as illustrated in FIG. 9, although it must exceed Vset in the existing driver circuit.

Figure 11:
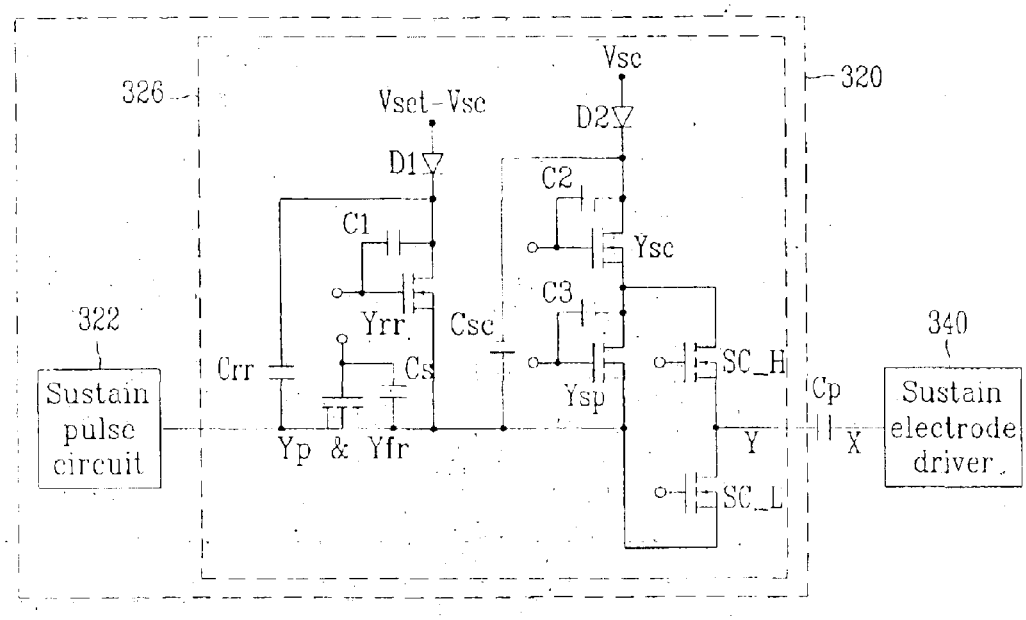

Next, reference will be made to FIG. 11 to describe a second embodiment of the present invention. FIG. 11 illustrates scan/sustain driver 300 according to the second embodiment of the present invention.

Unlike scan/sustain driver 300 in the first embodiment of the present invention, scan/sustain driver 300 in the second embodiment of the present invention includes main path switch Yp & Yfr as shown in FIG. 11, that combines main path switch Yp and second falling ramp switch Yfr of ramp waveform forming circuit 324 of FIG. 9. Namely, switch Yp & Yfr of FIG. 11 is made by removing second falling ramp switch Yfr of FIG. 9 and coupling capacitor Cs between the gate and drain of main path switch Yp.

The current path and the corresponding reset waveform in each mode according to the second embodiment of the present invention can be readily understood from the first embodiment of the present invention, and will not be further described.

The second embodiment of the present invention as described above reduces the number of switches by one to lower the cost of the product.

Next, a description will be given as to a third embodiment of the present invention with reference to FIGS. 12 and 13A to 13F.

Figure 12:
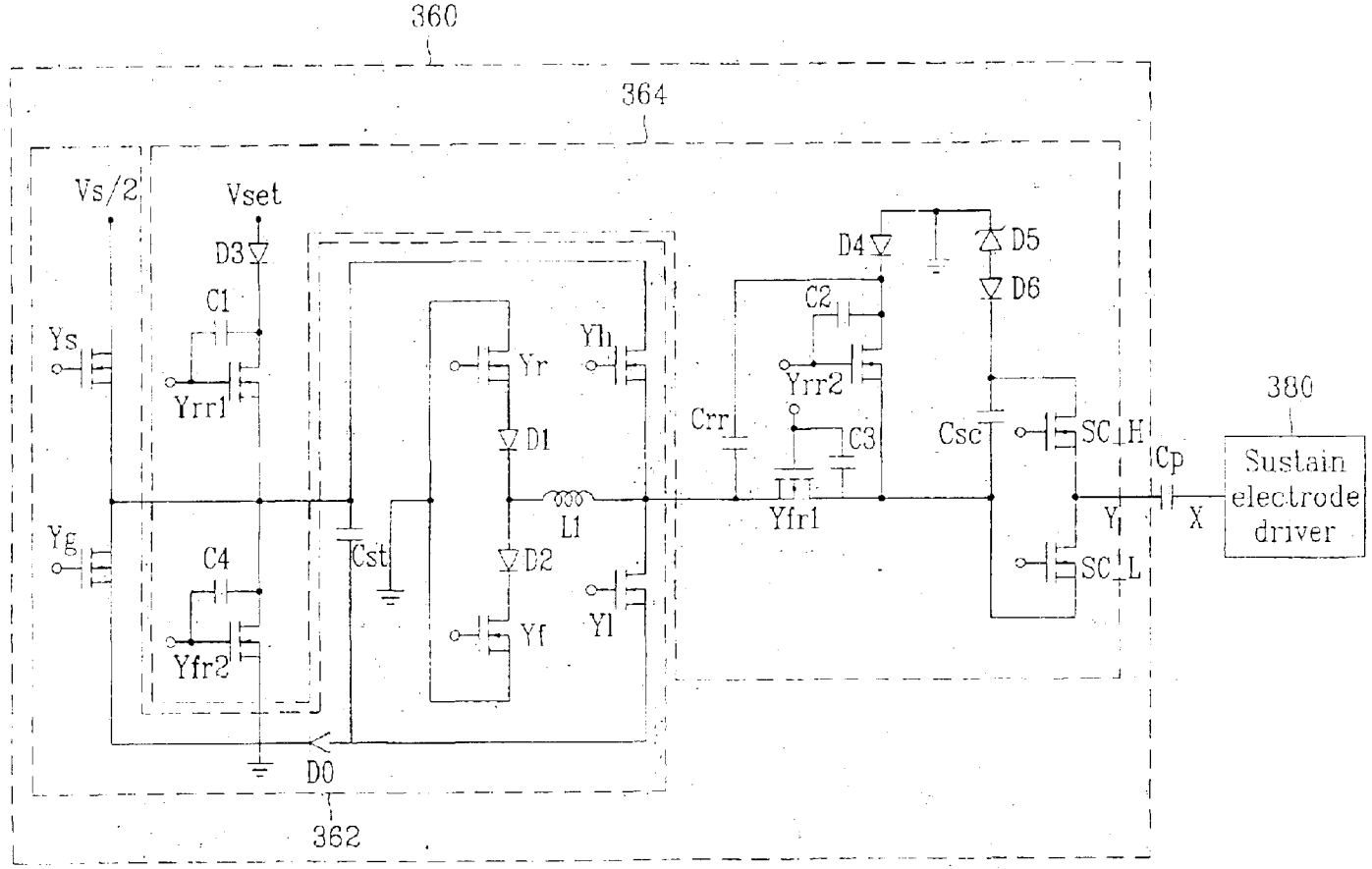

FIG. 12 illustrates scan/sustain driver 300 according to the third embodiment of the present invention which includes scan electrode driver 360 and sustain electrode driver 380, which are the same in structure. In the following description, the scan electrode driver 360 will be described alone.

Scan electrode driver 320 includes, as shown in FIG. 12, sustain pulse circuit 362 and ramp waveform forming circuit 364. Sustain pulse circuit 362 includes switches Ys, Yg, Yh, Yl, Yr and Yf, diodes D0, D1, and D2, inductor L1 and capacitor Cst.

Switches Ys and Yg are coupled in series between voltage Vs/2 and the ground voltage, and capacitor Cst is coupled between a contact of switches Ys and Yg and the ground voltage through diode D0. Switches Yh and Yl are coupled to both terminals of capacitor Cst, respectively, and inductor L1 is coupled to a contact of switches Yh and Yl. Switches Yr and Yf are coupled in parallel between inductor L1 and the ground voltage through diodes D1 and D2, respectively. Diodes D1 and D2 serve to determine the path of the charging/discharging current.

Capacitor Cst is charged with voltage Vs/2. The voltage of scan electrodes Y rises to Vs/2 or falls to −Vs/2 by the serial resonance of inductor L1 and panel capacitor Cp, and switches Ys and Yg serve to sustain the voltage of scan electrode at Vs/2 and −Vs/2, respectively.

Diode D0 functions as a switch that serves to interrupt the connection to the ground voltage when the contact voltage between capacitor Cst and the ground voltage is lower than the ground voltage.

Ramp waveform forming circuit 364 includes first rising ramp switch Yrr1 and second rising ramp switch Yrr2, first falling ramp switches Yfr1 and second falling ramp switch Yfr2, switches SC_H and SC_L, diodes D3, D4, D5, and D6 and capacitors Crr and Csc.

First rising ramp switch Yrr1 and second falling ramp switch Yfr2 are coupled in series between voltage Vset and the ground voltage. Second rising ramp switch Yrr2 coupled to the ground voltage is coupled to scan electrodes Y through switch SC_L. First falling ramp switch Yfr1 coupled to scan electrodes Y through switch SC_L is coupled to the contact of switches Yh and Yl, and serves to prevent a high voltage necessary for forming the reset waveform from being applied to sustain pulse circuit 362.

Each of the first and second rising ramp switches Yrr1 and Yrr2, and the first and second falling ramp switches Yfr1 and Yfr2, includes a MOS transistor and has a body diode.

First rising ramp switch Yrr1 and second rising ramp switch Yrr2, and first falling ramp switch Yfr1 and second falling ramp switch Yfr2 have capacitors C1, C2, C3, and C4 coupled between their gates and drains, respectively, thereby maintaining the voltage difference between the gate and source to supply a constant current to the scan electrodes, as expressed by Equation 1. Due to the effect of panel capacitor Cp, a voltage of the ramp waveform having a slope of i/Cp is formed, as expressed by Equation 2. The slope becomes gentler as the current i decreases. For the decrease in the current i, voltage Vgs is assured to be low as expressed by Equation 1. The magnitude of voltage Vgs can be controlled by the capacitance values of gate-drain capacitors C1, C2, C3, and C4. For the reset waveform according to the embodiment of the present invention, the later ramp waveform must have the gentler slope, so the capacitance values of capacitors C1, C2, C3, and C4 are regulated to make the later ramp waveform have the gentler slope.

Capacitor Crr is coupled between the contact of switches Yh and Yl and the ground voltage, capacitor Cst being coupled between switches Yg and Yl, and capacitor Csc being coupled between switch SC_H and first falling ramp switch Yfr1.

On the other hand, diode D3 serves to prevent the contact voltage between first rising ramp switch Yrr1 and voltage Vset from exceeding Vset. Diode D4 serves to interrupt the connection to the ground voltage when the contact voltage between capacitor Crr and the ground voltage exceeds the ground voltage. Likewise, diodes D5 and D6 serve to interrupt the connection when the contact voltage between capacitor Csc and the ground voltage exceeds the ground voltage.

Next, reference will be made to FIGS. 13A(1) to 13F(1) and FIGS. 13A(2) to 13F(2) to describe the PDP driving method according to the third embodiment of the present invention. FIGS. 13A(1) to 13F(1) illustrate the current path and FIGS. 13A(2) to 13F(2) illustrate the corresponding reset waveform, in each mode according to the third embodiment of the present invention. In the third embodiment of the present invention, it is assumed that before the start of Mode 1, switches Yg, Yl, and SC_L are in the "on" state to apply a voltage of −Vs/2 to scan electrodes Y. This is because both terminals of capacitor Cst are charged with voltage Vs/2. The contact voltage between capacitor Cst and switch Yg is the ground voltage, so the voltage of the other terminal of capacitor Cst becomes −Vs/2. With switch Yl in the "on" state, the voltage of −Vs/2 is applied to the one terminal of capacitor Crr and the voltage of Vs/2 is charged on capacitor Crr, because the voltage of the other terminal of capacitor Crr is the ground voltage. The voltage of −Vs/2 is applied between both terminals of capacitor Csc, so capacitor Csc is charged with the voltage of Vs/2.

(1) Mode 1—See. FIG. 13A(1) and FIG. 13A(2).

In Mode 1, switches $Y_1$ and SC_L are turned OFF, and switches Yh and SC_H are turned ON. Then, a current path is formed that includes switch Yg, switch Yh, the body diode of first falling ramp switch Yfr1, capacitor Csc, and switch SC_H, in sequence.

Capacitor Csc is charged with the voltage of Vs/2. As the ground voltage is applied to the one terminal of capacitor Csc, the charged voltage of Vs/2 is supplied to the terminal on the side of the scan electrodes, thereby applying a voltage of Vs/2 to scan electrodes Y.

(2) Mode 2—See. FIG. 13B(1) and FIG. 13B(2).

In Mode 2, switch Yg is turned OFF and first rising ramp switch Yrr1 is turned ON. Then, a current path is formed that includes first rising ramp switch Yrr1, switch Yh, the body diode of first falling ramp switch Yfr1, capacitor Csc, and switch SC_H, in sequence.

First rising ramp switch Yrr1 has capacitor C1 coupled between its gate and drain, so that the voltage difference between the gate and the source of first rising ramp switch Yrr1 is constant. Then, the voltage of scan electrodes Y rises in a ramp waveform due to the effect of panel capacitor Cp. Capacitor Csc is charged with the voltage of Vs/2, so the voltage of scan electrodes Y rises to the voltage of Vset+Vs/2 with a ramp waveform.

(3) Mode 3—See. FIG. 13C(1) and FIG. 13C(2).

In Mode 3, second rising ramp switch Yrr2 is turned ON. Then, a current path is formed that includes first rising ramp switch Yrr1, switch Yh, capacitor Crr, second rising ramp switch Yrr2, capacitor Csc, and switch SC_H, in sequence.

The contact voltage between second rising ramp switch Yrr2 and capacitor Crr becomes Vset+Vs/2. This is because both terminals of capacitor Crr are charged with the voltage of Vs/2, and the voltage of the other terminal of capacitor Crr is increased to Vset+Vs/2 as the contact voltage between capacitor Crr and switches Yh and Yl rises to Vset.

Second rising ramp switch Yrr2 has a capacitor between its gate and drain, so the voltage difference between the gate and the source of second rising ramp switch Yrr2 is constant. Then, the voltage of scan electrodes Y rises in a ramp waveform due to the effect of panel capacitor Cp. Capacitor Csc is charged with the voltage of Vs/2, so the voltage of scan electrodes Y rises to a voltage of Vset+Vs/2+Vs/2 with a ramp waveform.

The ramp waveform in this case has a slope that is assured to be gentler than the slope in Mode 2.

(4) Mode 4—See. FIG. 13D(1) and FIG. 13D(2).

In Mode 4, switches Ys, Yl, and SC_L are turned ON, and first rising ramp switch Yrr1 and second rising ramp switch Yrr2 are turned OFF. Then, a current path is formed that includes switch SC_L, the body diode of second rising ramp switch Yrr2, capacitor Crr, switch Yl, capacitor Cst, and switch Ys, in sequence.

Switch Ys is coupled to voltage Vs. In this case, capacitor Cst is charged with a voltage of Vs/2 and the voltage charged on either terminal of the capacitor does not change instantaneously. Hence, the contact voltage between capacitor Cst and switch Yl approaches zero. Either terminal of capacitor Crr is charged with a voltage of Vs/2, so the voltage of the scan electrode becomes Vs/2.

(5) Mode 5—See. FIG. 13E(1) and FIG. 13E(2).

In Mode 5, first falling ramp switch Yfr1 is turned ON. Then, a current path is formed that includes switch SC_L, first falling ramp switch Yfr1, switch Yl, capacitor Cst, and switch Ys, in sequence.

As switch Ys coupled to the voltage of Vs/2 is turned ON, the contact voltage between capacitor Cst and switch Ys becomes Vs/2. Capacitor Cst is charged with the voltage of Vs/2, so the voltage of the other terminal of capacitor Cst becomes the ground voltage. Accordingly, the voltage of the scan electrode falls to the ground voltage.

First falling ramp switch Yfr1 has a capacitor coupled between its gate and drain, so the voltage difference between the gate and the source of first falling ramp switch Yfr1 is constant, thereby forming a constant current. Hence, the voltage of scan electrodes Y falls to the ground voltage in a ramp waveform due to the effect of panel capacitor Cp.

(6) Mode 6—See. FIG. 13F(1) and FIG. 13F(2).

In Mode 6, switch Yfr2 is turned ON, and switch Ys is turned OFF. Then, a current path is formed that includes switch SC_L, first falling ramp switch Yfr1, switch Yl, capacitor Cst, and second falling ramp switch Yfr2, in sequence.

As switch Yfr2 coupled to the ground voltage is turned ON, the contact voltage between capacitor Cst and switch Yfr2 becomes the ground voltage. Capacitor Cst is charged with the voltage of Vs/2 and the voltage charged on either terminal of capacitor Cst cannot be changed instantaneously, so the voltage of the other terminal of capacitor Cst becomes −Vs/2. Accordingly, the voltage of scan electrodes Y falls to −Vs/2.

Second falling ramp switch Yfr2 has a capacitor coupled between its gate and drain, so the voltage difference between the gate and the source of second falling ramp switch Yfr2 is constant, thereby forming a constant current. Hence, the voltage of scan electrodes Y falls to −Vs/2 in a ramp waveform due to the effect of panel capacitor Cp.

The ramp waveform in this case has a slope that is assured to be gentler than the slope in Mode 5.

According to the third embodiment of the present invention, the withstand voltage of switches Ys, Yg, Yh, Yl, Yr, and Yf falls from Vs to Vs/2, allowing the use of inexpensive switches, thereby lowering the cost of the PDP.

As described above, the present invention allows the formation of a reset waveform capable of reducing the reset period and performing a stable reset operation in the PDP driving waveform, and reduces the withstand voltage of switches serving to interrupt the reset circuit and the sustain circuit, allowing the use of inexpensive switches and thereby lowering the cost of the PDP.

While this invention has been described in connection with what is presently considered to be practical embodiments, it is to be understood that the invention is not limited to the disclosed embodiments, but, on the contrary, is intended to cover various modifications and equivalent arrangements included within the spirit and scope of the appended claims.

What is claimed is:

1. A method for driving a plasma display panel that has a plurality of scan electrodes and sustain electrodes arranged in pairs, and a plurality of address electrodes intersecting the scan electrodes and the sustain electrodes and being electrically isolated from the scan electrodes and the sustain electrodes, the method comprising:

during a reset period, applying to the scan electrodes a voltage of a ramp waveform rising from a first voltage to a second voltage with substantially a first slope; and applying to the scan electrodes a voltage of a ramp waveform rising from the second voltage to a third voltage with substantially a second slope gentler than the first slope.

2. The method as claimed in claim 1, further comprising:

applying to the scan electrodes a voltage of a ramp waveform rising from the third voltage to a fourth voltage with substantially a third slope gentler than the second slope.

3. The method as claimed in claim 1, further comprising:

before applying to the scan electrodes a voltage of a ramp waveform rising from a first voltage to a second voltage with substantially a first slope, applying to the scan electrodes an erasing voltage of a ramp waveform erasing wall charges formed in a sustain period.

4. A method for driving a plasma display panel that has a plurality of scan electrodes and sustain electrodes arranged in pairs, and a plurality of address electrodes intersecting the scan electrodes and the sustain electrodes and being electrically isolated from the scan electrodes and the sustain electrodes, the method comprising;

during a reset period, applying to the scan electrodes a voltage of a ramp waveform falling from a first voltage to a second voltage with substantially a first slope; and applying to the scan electrodes a voltage of a ramp waveform falling from the second voltage to a third voltage with substantially a second slope gentler than the first slope.

5. The method as claimed in claim 4, further comprising:

applying to the scan electrodes a voltage of a ramp waveform failing from the third voltage to a fourth voltage with substantially a third slope gentler than the second slope.

6. An apparatus for driving a plasma display panel that has a plurality of scan electrodes and sustain electrodes arranged in pairs, and a plurality of address electrodes intersecting the scan electrodes and the sustain electrodes and being electrically isolated from the scan electrodes and the sustain electrodes, the apparatus comprising;

a first capacitor and a second capacitor coupled to a first voltage and a second voltage, respectively, the first capacitor and the second capacitor charged to a third voltage and a fourth voltage, respectively;

a first rising ramp switch coupled to one terminal of the first capacitor, for applying a voltage of a ramp waveform rising with substantially a first slope to the scan electrode;

a second rising ramp switch coupled to one terminal of the second capacitor, for applying a voltage of a ramp waveform rising with substantially a second slope to the scan electrodes;

a first falling ramp switch for applying a voltage of a ramp waveform falling with substantially a third slope to the scan electrodes; and a second falling ramp switch coupled between the one terminal of the first falling ramp switch and a fifth voltage, for applying a voltage of a ramp waveform falling with substantially a fourth slope to the scan electrodes.

7. The apparatus as claimed in claim 6, wherein the first voltage is a voltage high enough to uniformly redistribute wall charges of each cell of the plasma display panel minus the sum of a sustain voltage and the second voltage.

8. The apparatus as claimed in claim 6, wherein the third voltage is a voltage corresponding to the difference between the first and fifth voltages, and the fourth voltage is a voltage corresponding to the difference between the second and fifth voltages.

9. The apparatus as claimed in claim 6, wherein the fifth voltage is a ground voltage.

10. The apparatus as claimed in claim 6, wherein the first and second rising ramp switches and the first and second falling ramp switches include MOS transistors each having a body diode, each switch having a capacitor coupled between the gate and drain thereof, respectively.

11. The apparatus as claimed in claim 6, wherein the second slope is gentler than the first slope, and the fourth slope is gentler than the third slope.

12. A method for driving a plasma display panel that has a plurality of scan electrodes and sustain electrodes arranged in pairs, and a plurality of address electrodes intersecting the scan electrodes and the sustain electrodes and being electrically isolated from the scan electrodes and the sustain electrodes, the method comprising;

charging a first capacitor with a first voltage and a second capacitor with a second voltage;

supplying a substantially constant first current to the scan electrodes through the first capacitor, and increasing a voltage of the scan electrodes by the first voltage from a third voltage in a first slope;

supplying a substantially constant second current to the scan electrodes through the first and second capacitors, and increasing the voltage of the scan electrodes by the fourth voltage in a second slope;

decreasing the voltage of the scan electrodes to a fifth voltage through the second capacitor;

recovering a substantially constant third current from the scan electrodes, and decreasing the voltage of the scan electrodes to a sixth voltage in a third slope; and recovering a substantially constant fourth current from the scan electrodes, and decreasing the voltage of the scan electrodes to a seventh voltage in a fourth slope.

13. The method as claimed in claim 12, wherein the third voltage is a sustain voltage, and the seventh voltage is a ground voltage.

14. The method as claimed in claim 12, wherein the second slope is gentler than the first slope, and the fourth slope is gentler than the third slope.

15. An apparatus for driving a plasma display panel that has a plurality of scan electrodes and sustain electrodes arranged in pairs, and a plurality of address electrodes intersecting the scan electrodes and the sustain electrodes and being electrically isolated from the scan electrodes and the sustain electrodes, the apparatus comprising;

a first capacitor for charging a third voltage when one terminal thereof is coupled to a first voltage and an other terminal of the first capacitor is coupled to a second voltage;

a second capacitor and a third capacitor for respectively charging a fourth voltage and a fifth voltage;

a first rising ramp switch formed in a path between a sixth voltage and the third capacitor, for increasing a voltage of the scan electrodes in a ramp waveform having substantially a first slope;

a second rising ramp switch formed in a path generated by the first rising ramp switch, the second capacitor, and the third capacitor, for increasing the voltage of the scan electrodes in a ramp waveform having substantially a second slope;

a first falling ramp switch formed in a path between the scan electrodes and the other terminal of the first capacitor, for decreasing the voltage of the scan electrodes in a ramp waveform having substantially a third slope; and a second falling ramp switch formed in a path between the second voltage and the one terminal of the first capacitor, for decreasing the voltage of the scan electrodes in a ramp waveform having substantially a fourth slope.

16. The apparatus as claimed in claim 15, wherein the first voltage is a voltage being half a sustain voltage, and the second voltage is a ground voltage.

17. The apparatus as claimed in claim 15, wherein the second slope is gentler than the first slope, and the fourth slope is gentler than the third slope.

18. A method for driving a plasma display panel that has a plurality of scan electrodes and sustain electrodes arranged in pairs, and a plurality of address electrodes intersecting the scan electrodes and the sustain electrodes and being electrically isolated from the scan electrodes and the sustain electrodes, the method comprising:

charging a first capacitor having one terminal thereof selectively coupled to a first voltage and a second voltage, a second capacitor, and a third capacitor with a third voltage, a fourth voltage, and a fifth voltage, respectively, and the third voltage corresponding to a difference between the first voltage and the second voltage;

applying the second voltage to the scan electrodes through the third capacitor to change a voltage of the scan electrodes to a sixth voltage;

supplying a substantially constant first current to the scan electrodes through a seventh voltage and the capacitor to increase the voltage of the scan electrodes to an eighth voltage in a ramp waveform having a first slope;

supplying a substantially constant second current to the scan electrodes through the seventh voltage and the second and third capacitors to increase the voltage of the scan electrodes to a ninth voltage in a ramp waveform having a second slope;

decreasing the voltage of the scan electrodes to the tenth voltage through the second and first capacitors while one terminal of the first capacitor is coupled to the first voltage;

recovering a substantially constant third current to the first voltage from the scan electrodes through the first capacitor while one terminal of the first capacitor is coupled to the first voltage, to decrease the voltage of the scan electrodes to an eleventh voltage in a ramp waveform having a third slope; and recovering a substantially constant fourth current to the second voltage from the scan electrodes while one terminal of the first capacitor is coupled to the second voltage, to decrease the voltage of the scan electrodes to a twelfth voltage in a ramp waveform having a fourth slope.

19. The method as claimed in claim 18, wherein the second slope is gentler than the first slope, and the fourth slope is gentler than the third slope.

20. The method as claimed in claim 18, wherein the first voltage is a voltage being half a sustain voltage, and the second voltage is a ground voltage.

21. The method as claimed in claim 18, the sixth voltage being the sum of the second and fifth voltages, the eighth voltage being the sum of the fifth and seventh voltages, the ninth voltage being the sum of the seventh, fourth, and fifth voltages, the tenth voltage being the sum of the second and fourth voltages, the eleventh voltage being the first voltage minus the third voltage, and the twelfth voltage being the second voltage minus the third voltage.

* * * * *